US006902292B2

(12) United States Patent
Lai

(10) Patent No.: US 6,902,292 B2
(45) Date of Patent: Jun. 7, 2005

(54) REFINED ILLUMINATING LAMP STRUCTURE

(76) Inventor: Li-Chun Lai, 21F.-1, No. 33, Sec. 1, Mingsheng Rd., Panciao City, Taipei (TW)

( * ) Notice: Subject to any disclaimer, the term of this patent is extended or adjusted under 35 U.S.C. 154(b) by 4 days.

(21) Appl. No.: 10/704,618

(22) Filed: Nov. 12, 2003

(65) Prior Publication Data

US 2005/0099802 A1 May 12, 2005

(51) Int. Cl.[7] ..... E01F 9/00
(52) U.S. Cl. ..... 362/153.1; 362/153; 362/269
(58) Field of Search ..... 362/269, 145, 362/153, 153.1

(56) References Cited

U.S. PATENT DOCUMENTS

| | | | | | |
|---|---|---|---|---|---|
| 5,003,439 | A | * | 3/1991 | Yang | 362/153 |
| 5,249,109 | A | * | 9/1993 | Denison et al. | 362/285 |
| 5,599,091 | A | * | 2/1997 | Kira | 362/269 |
| D422,735 | S | * | 4/2000 | Lam | D26/68 |
| D495,444 | S | * | 8/2004 | Lam | D26/67 |
| D496,484 | S | * | 9/2004 | Lam | D26/67 |

* cited by examiner

*Primary Examiner*—Laura K. Tso
(74) *Attorney, Agent, or Firm*—Rosenberg, Klein & Lee

(57) ABSTRACT

A refined illuminating lamp structure is disclosed. A lamp case is pivotally connected to a top surface of the holder so as to reverse on the top surface of a holder. The bottom surface of the holder is connected with a taper body. The top surface of the taper body has a wire-fixing opening mounted thereon and a power conducting element is set at the connecting plane of the holder and the taper body. The power conducting element has one end which is a conducting wire and the other end exposed to have an awl conducting piece. The conducting piece is placed in the wire-fixing opening and the conducting wire connects with the illuminator inside the lamp case along the side of the holder. Several illuminating lamps are simultaneously plugged in the outdoor lawn and a long conducting wire having a power socket is placed in the power fixing opening at the top surface of the taper body. When the holder and the taper body are connected together, the conducting pieces of the power conducting element will immediately penetrate through the insulating layer of the long conducting wire and contact with the copper wire so that the illuminator inside the lamp can produce light for achieving the purpose of illuminating.

7 Claims, 7 Drawing Sheets

REFINED ILLUMINATING LAMP STRUCTURE

BACKGROUND OF THE INVENTION

1. Field of the Invention

The present invention relates to a refined illuminating lamp structure, and more particular to a refined illuminating lamp structure which can make multiple illuminating lamps to produce light at the same time only through one long conducting wire.

2. Description of the Prior Art

The illuminating lamp is really an important electric equipment for people nowadays. In addition to providing an illumination for dark, it also can present a beautiful and touching visual effect at night for buildings, flowers and plants, and trees so as to clear off the tiredness accumulated all the day.

However, although the illuminating lamp can intersperse the night to be so beautiful, in the prior art, one illuminating lamp has to equip with one set of power conducting wires. That means when multiple illuminating lamps are under using, it has to consume multiple power sockets. Once the power sockets are insufficient, the number of the illuminating lamps which can be used will be accordingly decreased so as to cause an imperfect illuminating effect. Therefore, this situation really needs to be improved.

Thus, it can be seen, the prior art described above still has some defects, is not a good design, however, and is urgently to be improved.

Because of the technical defects of described above, the applicant keeps on carving unflaggingly to develop a refined illuminating lamp structure through wholehearted experience and research.

SUMMARY OF THE INVENTION

An object of the present invention is to provide a refined illuminating lamp structure which does not need to set any power socket.

Another object of the present invention is to provide a refined illuminating lamp structure which can make multiple illuminating lamps to produce light at the same time only through employing an extended conducting wire.

Another further object of the present invention is to provide a refined illuminating lamp structure which can be plugged in the outdoor lawn and the illuminating angle thereof also can be adjusted, so that it can increase the sensing beauty of the gardens and buildings.

For achieving the purposes described above, the refined illuminating lamp structure includes a lamp case, a holder, a taper body and a covering plate. The lamp case includes a upper case and a lower case, wherein said lower case has a connecting portion mounted at an end terminal thereof and said connecting portion has a conducting opening mounted thereon and an opening mounted aside said conducting opening. The holder has a pivot-connecting portion extended form a top end thereof, in which the pivot-connecting portion extends a hollow pillar from a top end thereof and has a trough mounted on a bottom thereof, a container set at one side of the holder, in which the container includes several holes set inside thereof, and a power conducting element connected to the bottom surface of the holder. The power conducting element includes one end being a conducting wire and the other end comprising two exposed awl conducting pieces, wherein the power conducting element is contained in the container of the holder. The pivot-connecting portion of the holder and the connecting portion of the lower case are connected together, so that the hollow pillar at the top surface of the pivot-connecting portion will penetrate through the conducting opening of the connecting portion. Moreover, through fixedly locking the locking and fixing element with the hollow pillar, the holder and the lamp case can be pivotally connected together so that the lamp case can be reversed on the top surface of the holder through the conducting opening of the connecting portion and the conducting wire of the power conducting element can enter the lamp case along the container of the holder through the opening of the connecting portion of the lamp case for further electrically connecting to the light. The covering plate is designed to have a shape corresponding to the shape of the container of the holder, wherein the covering plate is covered on one side of the holder for sealing the container, so that the conducting wire can be hidden in the container for achieving a purpose of being beautiful. And, the top surface of the taper body further comprises a conducting wire fixing opening set thereon. When the top surface of the taper body is pivotally connected to the bottom surface of the holder, the awl conducting pieces of the power conducting element will be contained in the wire-fixing opening. As operating, several illuminating lamps are plugged in the outdoor lawn and an extended conducting wire having a power socket is placed in the power fixing opening at the top surface of the taper body. When the holder and the taper body are pivotally connected together, the conducting pieces of the power conducting element will immediately penetrate through the insulating layer of the extended conducting wire and contact with the copper wire so that the power can be transmitted to the illuminator inside the lamp case through the power conducting element so as to make the illuminator to produce light for achieving the purpose of illuminating.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
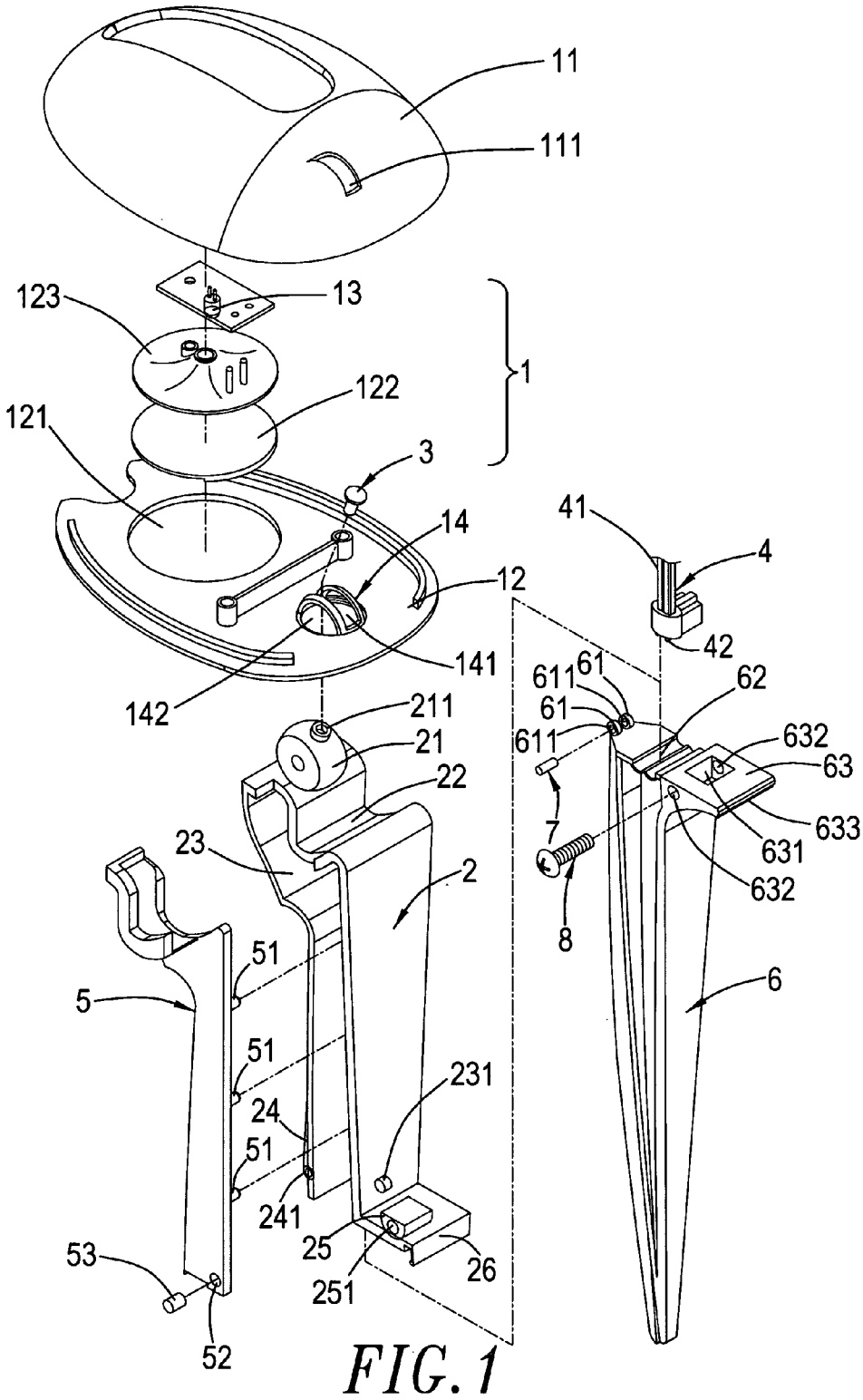
FIG. 1 is an explosive view showing a refined illuminating lamp structure according to the present invention.
Figure 2:
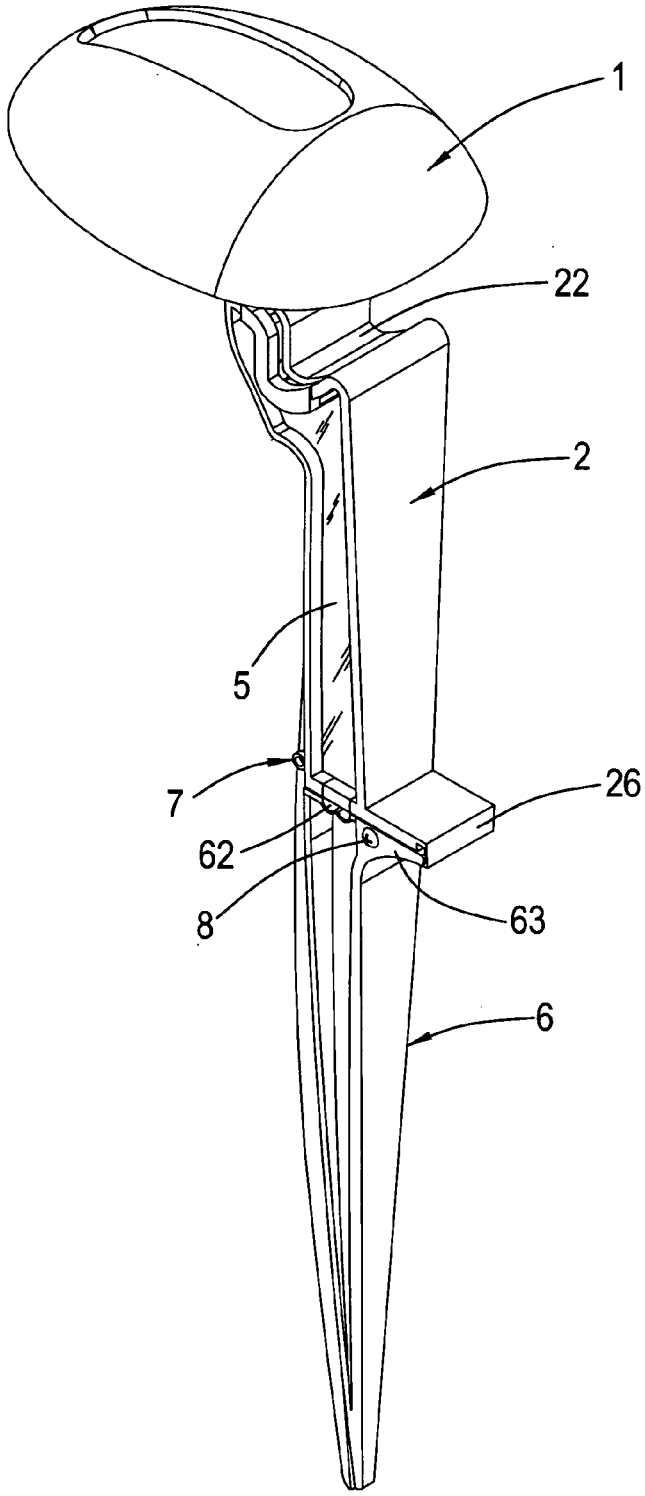
FIG. 2 is a three-dimensional schematic view showing a refined illuminating lamp structure according to the present invention.
Figure 3:
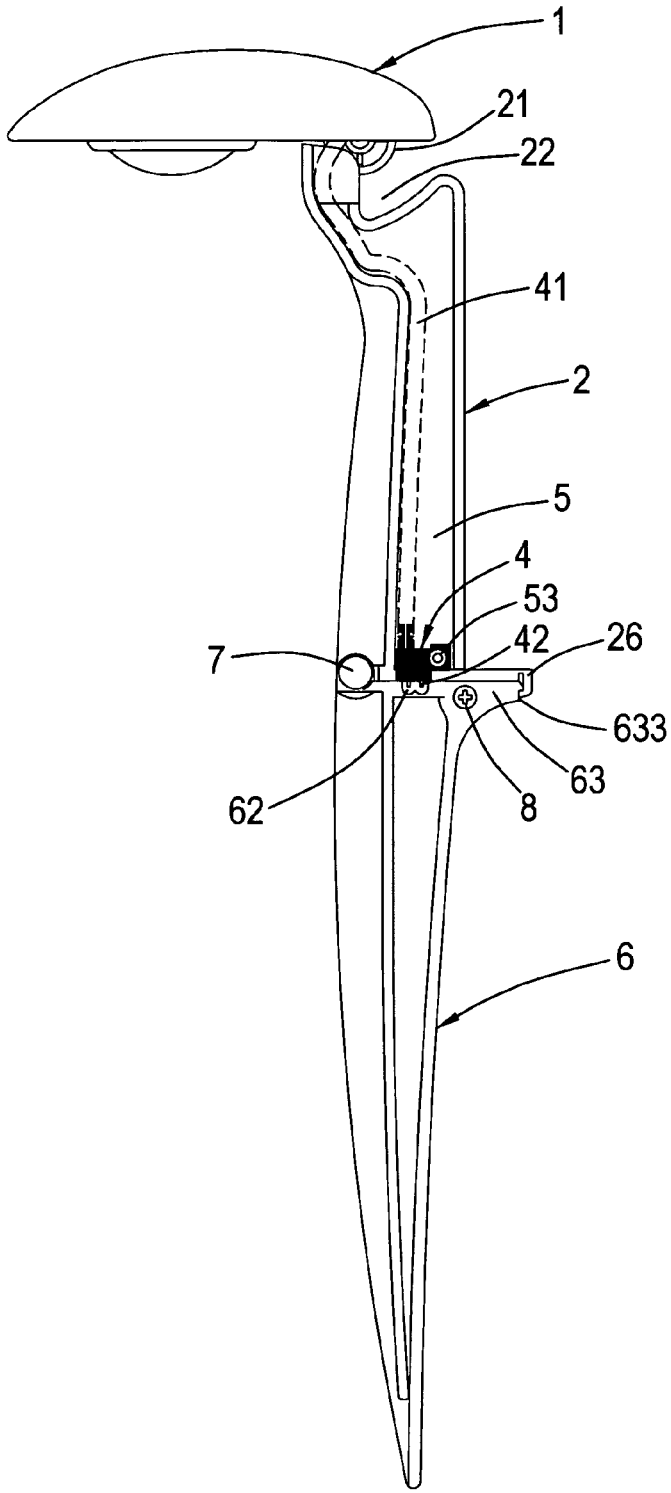
FIG. 3 is a side view showing a refined illuminating lamp structure according to the present invention.
Figure 4:
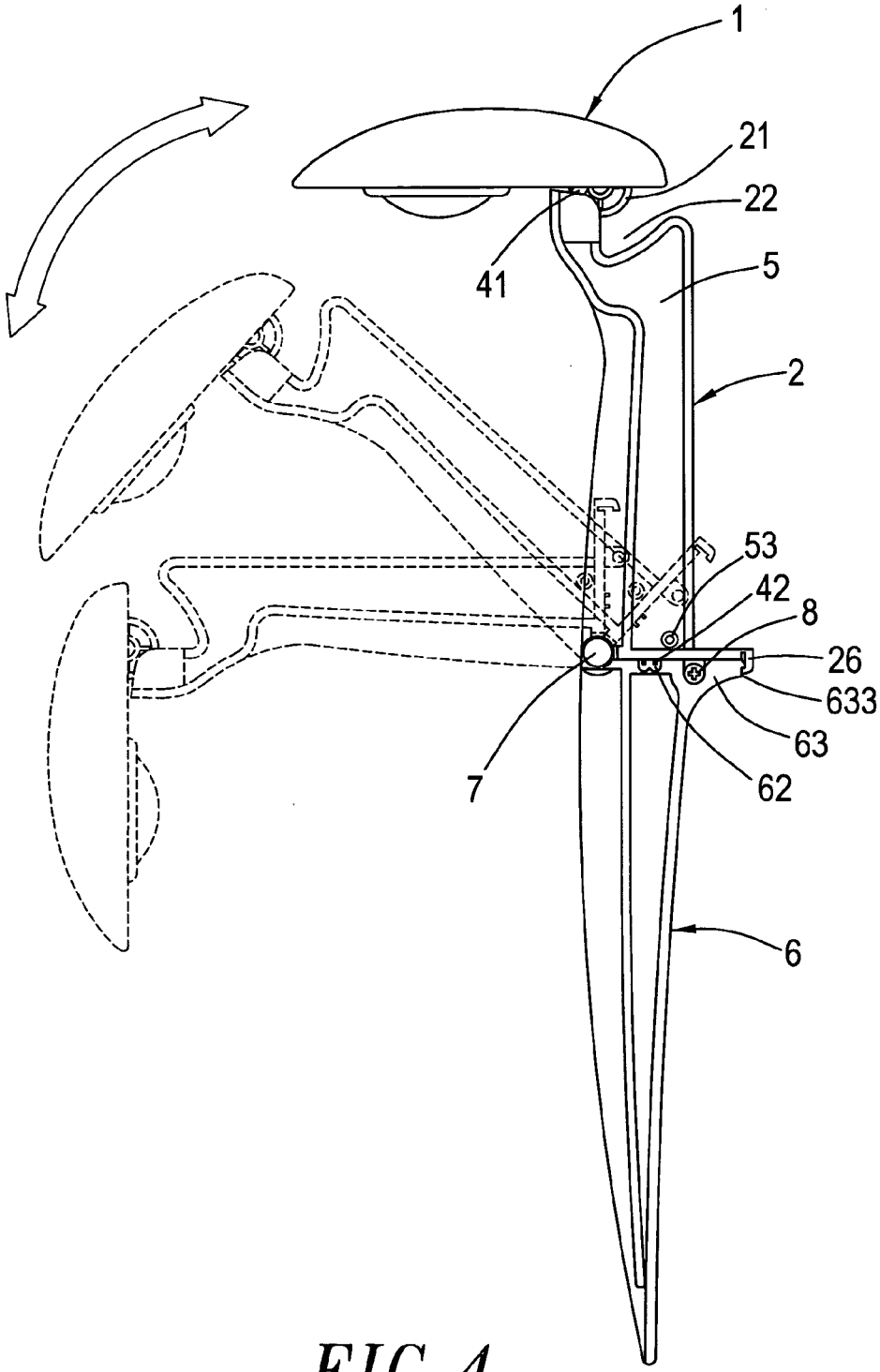
FIG. 4 is a movement schematic view showing a refined illuminating lamp structure according to the present invention.
Figure 5:
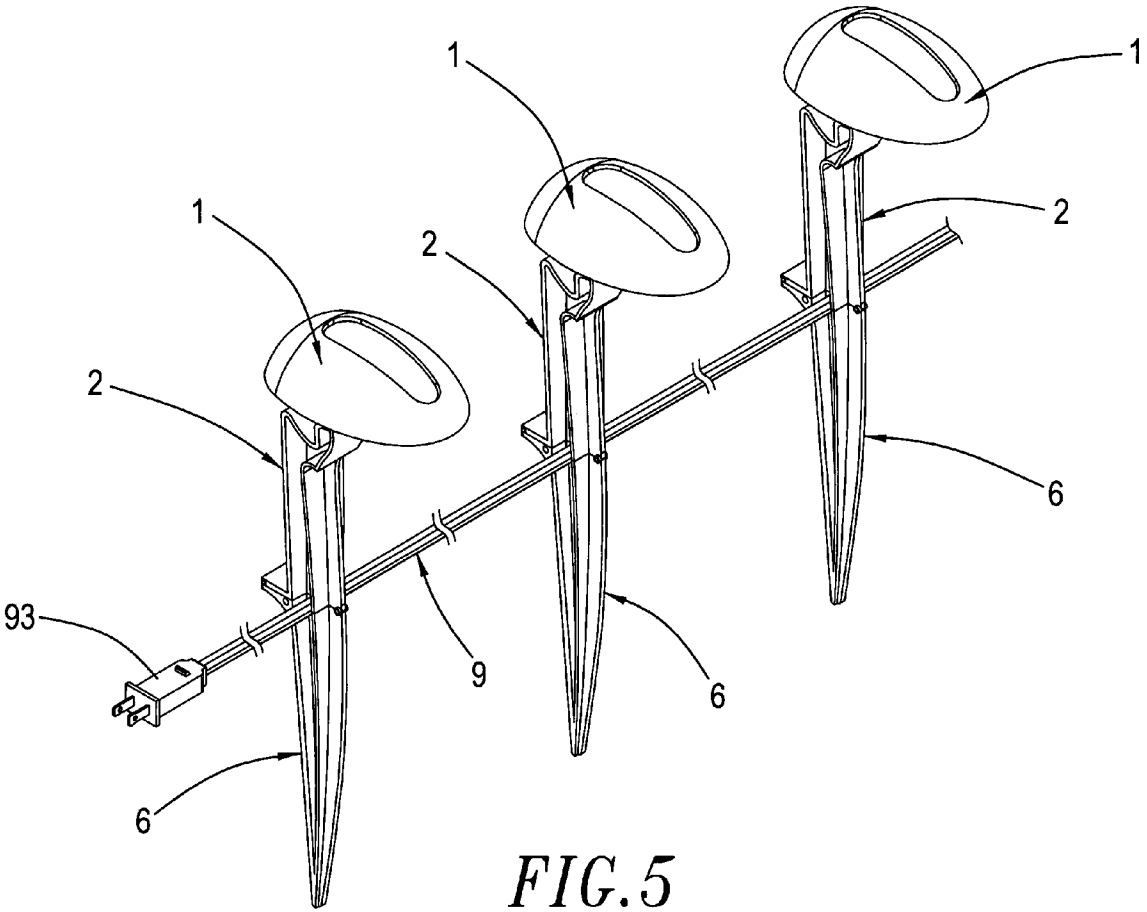
FIG. 5 is a practical schematic view showing a refined illuminating lamp structure according to the present invention.
Figure 6A:
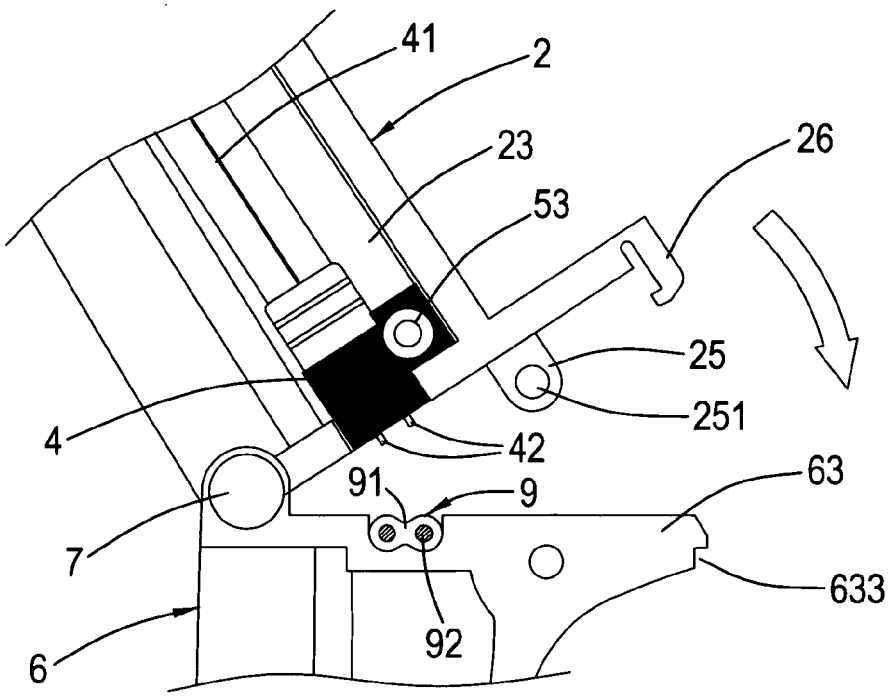
FIGS. 6A–B are partial movement schematic views showing a refined illuminating lamp structure according to the present invention.
Figure 6B:
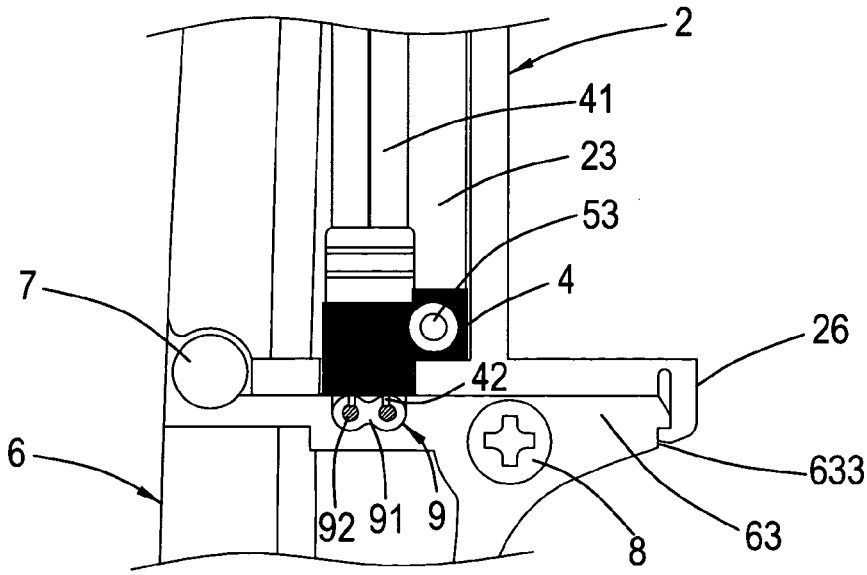
Figure 7:
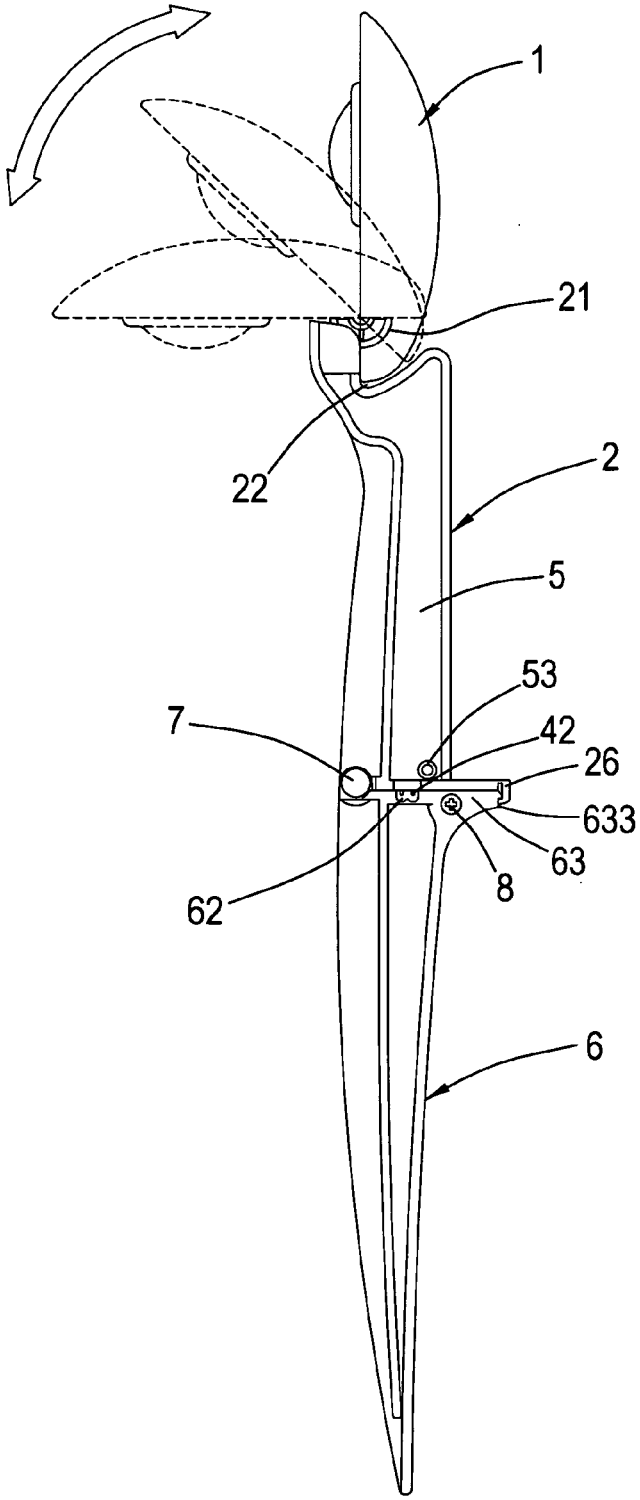
FIG. 7 is a schematic view showing a lamp reversion of a refined illuminating lamp structure according to the present invention.

Please refer to FIGS. 1–3 which illustrate a refined illuminating lamp structure according to the present invention. The refined illuminating lamp structure mainly includes:

a lamp case 1 constructed by a upper case 11 and a lower case 12, wherein the lower case 12 has a hole 121 set at a central portion thereof, in which the hole 121 is sequentially connected with a lampshade 122 and a socket 123 having an illuminator 13 mounted therein, the lower case 12 has a connecting portion 14 downwardly extending from an end terminal thereof, in which the connecting portion 14 includes an arc conducting-opening 141 and an opening 142 set at one side of the arc conducting-opening 141, and the upper case 11 has an arc conducting-trough 111 set thereon at a position corresponding to the arc conducting-opening 141 on the connecting portion 14 of the lower case 12;

a holder 2 having a pivot-connecting portion 21 mounted on a top end thereof, in which the pivot-connecting portion 21 extends a hollow pillar 211 from a top end thereof and has a trough 22 mounted on a bottom thereof, a container 23 set at one side of the holder 2, in which the container 12 includes several holes (not shown) set inside thereof and a fixing opening 231 set at a bottom surface thereof, a positioning plate 24 set at one side of the bottom surface of the holder 2, in which the positioning plate 24 has a hole 241 set thereon and a plate body 25 having a hole 251 mounted thereon downwardly extends from a central portion thereof, and a fastener 26 set at the other side of the bottom surface of the holder 2, wherein pivot-connecting portion at the top terminal of the holder 2 is pivotally connected with the connecting portion 14 of the lamp case 1, so that the hollow pillar 211 of the pivot-connecting portion 21 is penetrated through the conducting-opening 141 of the connecting portion 14, and furthermore, through a locking and fixing element 3 locking inside the hollow pillar 211, the holder 2 and the lamp case 1 are fixedly connected and the lamp case 1 is reversible on the holder 2 for adjusting an illuminating angle;

a power conducting element 4 having one end being a conducting wire 41 and the other end comprising two exposed awl conducting pieces 42, wherein the power conducting element 4 is connected with the bottom surface of the holder 2 so that the conducting wire 41 enters the lamp case 1 through the opening 142 along the container 23 of the holder 2 so as to connect with the illuminator 13, and the awl conducting pieces 42 at the other end of the power conducting element 4 are exposed out of the bottom surface of the holder 2;

a covering plate 5, in which the covering plate 5 is designed to have a shape corresponding to a shape of the container 23 of the holder, and has plural positioning pillars 51 extended from one side thereof and an opening 52 mounted at one side of a bottom terminal thereof, wherein the covering plate 5 is covered on the container 23 at one side of the holder 2, so that the positioning pillars 51 on the covering plate 5 are inserted into the opening inside the container 12, the opening 52 at the bottom terminal is corresponding to the fixing opening 231 of the container 23 and are riveted by a rivet 53 so as to fixedly seal the container 23 with the covering plate, and thus the conducting wire 41 of the power conducting element 4 is hidden in the container 23 for achieving a purpose of being beautiful; and a taper body 6, wherein the taper body 2 includes two corresponding lugs 61 mounted at one side of a top terminal thereof, in which the lugs respectively has a corresponding opening 611 set thereon, a wire-fixing opening 62 set at a central portion of the taper body 6, a positioning plate 63 extended from the other side of the taper body, in which the positioning plate 63 has a positioning trough 631 set thereon which has a penetrating opening 632 mounted thereon and a fastening trough 633 mounted at an end facet of the positioning plate 63, wherein the top surface of the taper body 6 is connected with the bottom surface of the holder 2, so that the positioning plate 24 at on side of the bottom surface of the holder 2 can be contained between the two lugs 61 at one side of the taper body 6 and the openings 241 and 611 can be corresponding to each other, further through a penetrating of a pivoting axle 7, the holder 2 is reversible on the taper body 6, when the bottom surface of the holder 2 and the top surface of the taper body 6 are completely closed together, the awl conducting pieces 42 of the power conducting element 4 will be contained in the wire-fixing opening 62 and the fastener 26 at the other side of the holder 2 will be immediately fastened with the fastening trough 633 on the positioning plate 63 of the taper body so as to make the plate body 25 at the bottom surface of the holder 2 to be contained in the positioning trough 631 of the taper body 6 and thus the opening 251 of the plate body 25 and the penetrating opening 632 of the positioning trough are corresponding to each other, and furthermore, through penetrating locking by a locking and fixing element 8, the holder 2 and the taper body 6 can be fixedly connected into one.

Moreover, please refer to FIGS. 4–7, which illustrate the schematic operation views according to the present invention. The user can simultaneously plug the taper bodies 6 of multiple illuminating lamps in the outdoor lawn and lift the holder 2 at an angle so as to expose the wire-fixing opening 62 of the taper body 6 for containing a long conducting wire 9 therein and, through the long conducting wire 9, multiple illuminating lamps can be connected in parallel. Then, the bottom surface of the holder 2 is closed to the top surface of the taper body 6, so that the awl conducting pieces 42 of the power conducting element 4 will penetrate through an insulating layer 91 of the long conducting wire 9 and contact with a copper wire 92. Once the power plug 93 of the long conducting wire 9 is plugged into the socket, the power can pass through the long conducting wire 9 and transmit to the conducting pieces 42 of the power conducting element 4. Moreover, through the transmission to the illuminators 13 by the conducting wire 41 of the power conducting element 4, the illuminators 13 in multiple illuminating lamps all can produce a light at the same time for illuminating the outdoor environment. Furthermore, the lamp case 1 can be pivotally reversed through taking the hollow pillar 211 of the pivot-connecting portion 21 of the holder 2 as an axle. During reversion, the top surfaces of the locking and fixing elements 3 fixedly locked on the hollow pillar 211 all will be contacted with the arc conducting trough 11 of the upper case 11, so that the lamp case 1 can be positioned at any angle as reversing. However, once the lamp case 1 is reversed to a position at 90 degrees, the rear portion of the lamp case 1 will immediately be contained in the trough 22 of the holder 2 so as to limit a continuing reversion of the lamp case.

The refined illuminating lamp structure according to the present invention, when being compared with the other prior arts, further includes the advantages as follows:

1. The present invention does not need to set any power socket and still can make multiple illuminating lamps to produce light at the same time only through employing an extended conducting wire.

2. The present invention can be plugged in the outdoor lawn and the illuminating angle thereof also can be adjusted, so that it can increase the sensing beauty of the gardens and buildings.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A refined illuminating lamp structure, comprising:

a lamp case having an illuminator mounted therein and comprising a upper case and a lower case, wherein said lower case has a connecting portion mounted at an end terminal thereof and said connecting portion has a conducting opening mounted thereon and an opening mounted aside said conducting opening;

a holder having a pivot-connecting portion mounted on a top thereof and a container mounted aside said holder, wherein said pivot-connecting portion is connected with said connecting portion of said lamp case so that said lamp case is fixedly connected with said holder and is reversible on said holder;

a taper body having a wire-fixing opening mounted thereon, wherein said taper body is connected with a bottom surface of said holder through a top surface thereof and is pivotally connected to said bottom surface of said holder through a side surface thereof so that said holder is reversible on said taper body, characterized in that:

a power conducting element having one end being a conducting wire and the other end comprising two exposed awl conducting pieces, wherein said power conducting element is connected with said bottom surface of said holder so that said conducting wire enters said lamp case along said container of said holder and connects with said illuminator, and said awl conducting pieces at the other end of said power conducting element is exposed out of said bottom surface of said holder; and when the bottom surface of said holder is completely closed to said top surface of said taper body, said awl conducting pieces at the other end of said power conducting element are contained in said wire-fixing opening of said taper body.

2. The refined illuminating lamp structure according to claim 1, wherein a top terminal of said pivot-connecting portion of said holder extends a hollow pillar, when said pivot-connecting portion is pivotally connected to said lamp case, said hollow pillar then passes through said conducting opening of said connecting portion of said case, and through locking a locking and fixing element inside said hollow pillar, said holder and said lamp case are fixedly connected and said lamp case is reversible on said holder.

3. The refined illuminating lamp structure according to claim 1, wherein said uppercase of said lamp case further comprises an arc conducting-trough mounted on an end facet thereof, and when said lamp case is reversed on said holder, said locking and fixing element locked inside said hollow pillar of said pivot-connecting portion then contacts with said arc conducting-trough for positioning said lamp case at any angle as reversing.

4. The refined illuminating lamp structure according to claim 1, wherein said lowercase of said lamp case further comprises a hole mounted at a central portion thereof, said hole is sequentially connected with a lampshade and a socket, and said illuminator is contained in said socket.

5. The refined illuminating lamp structure according to claim 1, wherein said bottom surface of said holder further comprises a positioning plate set at one side of said bottom surface, in which said positioning plate has an opening mounted thereon and a plate body having an opening mounted thereon downwardly extended from a central portion of said positioning plate, and a fastener extended from the other side of said bottom surface, said taper body further comprises two corresponding lugs mounted on one side of said top surface thereof, in which said lugs respectively has a corresponding opening mounted thereon, a wire-fixing opening mounted at a central portion of said top surface, and a positioning plate extended from the other side of said top surface, in which said positioning plate has a positioning trough mounted thereon which has a penetrating opening mounted thereon and a fastening trough mounted on an end facet of said positioning plate, when said taper body is connected with said holder, said positioning plate of said holder is then contained between said two lugs and said openings thereon are corresponding to each other, further through a penetrating of a pivoting axle, said holder is reversible on said taper body, once said bottom surface of said holder and said top surface of said taper body are completely closed together, said fastener at the other side of said holder is immediately fastened with a fastening trough on said positioning plate of said taper body so as to make said plate body at said bottom surface of said holder to be contained in said positioning trough of said taper body and thus said opening of said plate body and said penetrating opening of said positioning trough are corresponding to each other, and furthermore, through penetrating locking by a locking and fixing element, said holder and said taper body are fixedly connected into one.

6. The refined illuminating lamp structure according to claim 1, wherein said container at one side of said holder is covered by a covering plate for hiding said conducting wire inside said container.

7. The refined illuminating lamp structure according to claim 6, wherein said covering plate is designed to have a shape matched with that of said container of said holder.

* * * * *